United States Patent [19]

Garrett

[11] Patent Number: 4,662,461

[45] Date of Patent: May 5, 1987

[54] FIXED-CONTACT STABILIZER

[76] Inventor: William R. Garrett, 24 Palmer Dr., Conroe, Tex. 77302

[21] Appl. No.: 287,769

[22] Filed: Jul. 29, 1981

Related U.S. Application Data

[63] Continuation-in-part of Ser. No. 187,350, Sep. 15, 1980, abandoned.

[51] Int. Cl.[4] ..... E21B 17/10

[52] U.S. Cl. ..... 175/325

[58] Field of Search ..... 175/325, 315, 406, 407, 175/346; 308/4 A; 403/339, 381, 354, 316, 317, 318, 319; 407/48, 52; 408/59, 227, 231, 233

[56] References Cited

U.S. PATENT DOCUMENTS

| | | | |
|---|---|---|---|
| 517,348 | 3/1894 | Linderman | 403/381 |
| 1,592,268 | 7/1926 | Hill . | |
| 1,932,488 | 10/1933 | Scott | 255/73 |
| 3,051,255 | 8/1962 | Deely | 175/265 |
| 3,180,439 | 4/1965 | Deely | 175/286 |
| 3,237,705 | 5/1966 | Williams, Jr. | 175/406 |
| 3,454,308 | 7/1969 | Kennedy | 308/4 A |
| 3,680,647 | 8/1972 | Dixon et al. | 308/4 A X |
| 4,106,823 | 8/1978 | Bassinger | 175/325 X |
| 4,190,124 | 2/1980 | Terry | 175/325 X |
| 4,280,742 | 7/1981 | Justman | 308/4 A |

*Primary Examiner*—Stuart S. Levy
*Assistant Examiner*—David Werner
*Attorney, Agent, or Firm*—Vaden, Eickenroht, Thompson & Boulware

[57] ABSTRACT

A drill string stabilizer in which the wall-contacting wear elements or blades are secured in their accommodating pockets by a lateral interference fit. One embodiment includes recess-and-protection connections between end-to-end aligned, individual wear elements, the surfaces of mating parts permitting rotation. Cap screws and locking blocks are also employed in some embodiments. Surfaces of the locking block and the pocket permit its insertion without longitudinal movement. An alternate embodiment not using a plurality of elements or a locking block employs a transverse thrust surface which is slightly angled to permit rotation fitting into the accommodating pocket. The blades are made to assure uniform side pressure within their respective accommodating pockets by slight inward dimension tapering or by longitudinal underneath blade slotting to provide a leg structure that flexes, the tapering or slotting acting in opposition to natural loosening that would occur if a uniformly dimensioned and non-flexible blade were pressed into a uniformly dimensioned pocket.

56 Claims, 21 Drawing Figures

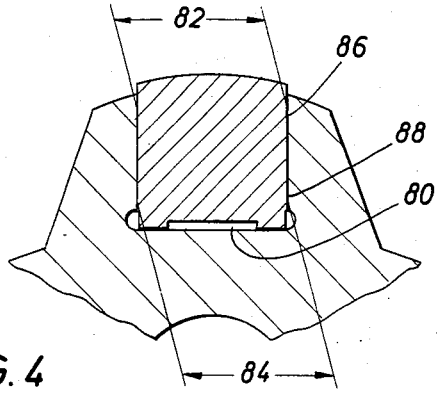
FIG. 4
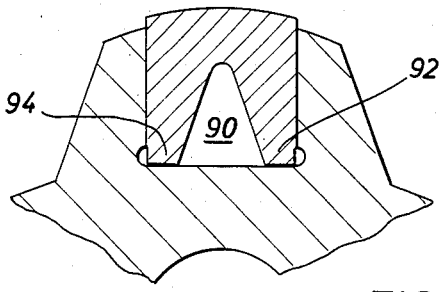
FIG. 5
FIG. 6
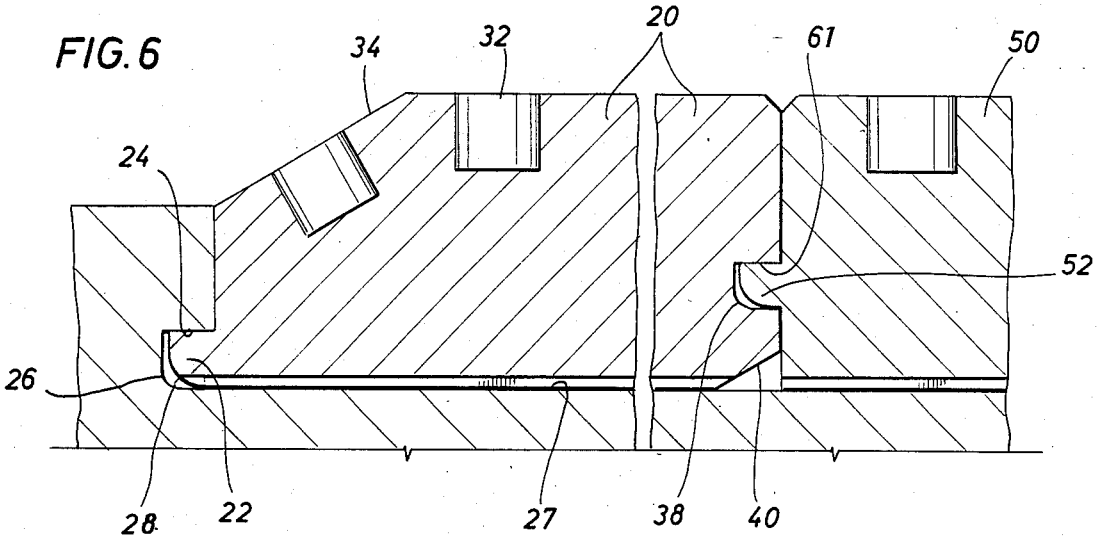
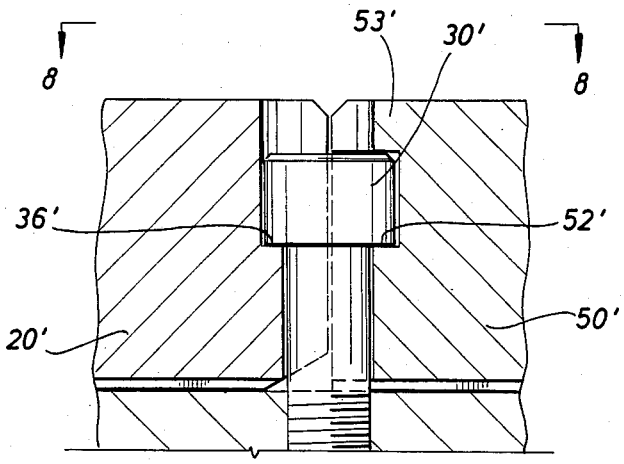
FIG. 7
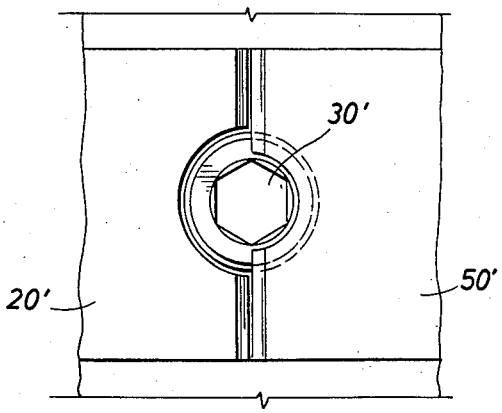
FIG. 8

FIXED-CONTACT STABILIZER

This is a continuation-in-part of patent application Ser. No. 187,350, filed Sept. 15, 1980 entitled "Fixed-Contact Stabilizer" in the name of William R. Garett, now abandoned.

BACKGROUND OF THE INVENTION

1. Field of the Invention

This invention pertains to borehole drilling apparatus and more specifically to that part of a drill string known in the industry as a stabilizer.

2. Description of the Prior Act

Stabilizers, sometimes referred to as drill collar stabilizers or as drill stem stabilizers, have been employed in earth boring operations for the petroleum industry to centralize the drill stem in the borehole, usually especially in the drill collar section at a distance of from 100 feet to 300 feet above the drill bit. The purposes of a stabilizer are to (1) help control hole angle direction, (2) prevent the bit from drifting laterally, which would result in undesirable dog-legs and ledges, and (3) improve bit performance by forcing the bit to centrally rotate about its axis so as to provide substantially equal force loading on all three drill bit cones. In addition, stabilizers also may be used to provide a reaming function for undersized or irregularly shaped boreholes provided the formation is not too hard. Rolling cutter reamers are employed to provide these functions for formations too hard to be thus treated by a stabilizer.

Stabilizers may be further categorized as rotating stabilizers and as non-rotating stabilizers. Non-rotating stabilizers do not rotate as the drill string is turned, its wall-contacting members merely moving longitudinally along the wall as the drill string is lowered and raised. On the other hand, a rotating stabilizer includes wall-contacting members that rotationally track along the wall of the borehole as the drill string is turned. In addition, rotating stabilizers can be further divided into fixed-contact and rolling contact types, which latter type would be functionally equivalent to a roller-reamer.

The contacting members of a fixed-contact type of stabilizer, which is the type of stabilizer described herein, are subjected to the various forces attendant to the entire drill string, the severest of which is often the longitudinal thrust force and the most constant and aggravating of which are the fretting forces. It should be noted that forces applied to the drill string are a result of the drill string manipulations, the conditions of the bore, and the fluid conditions internal and external to the drill string.

One fixed-contact type stabilizer is shown in U.S. Pat. No. 3,454,308, Kennedy, in which two wear bars are positioned end-to-end on either side of a locking bar within an accommodated slot, the wear bars being dovetailed to fit under tapered end surfaces of the slot and a locking bar. The locking bar is secured by a cap screw. Should the cap screw not be adequately tightened or should the cap screw vibrate loose, the wear bars are in danger of falling out during use of the tool.

Another fixed-contact type stabilizer is shown in U.S. Pat. No. 3,818,999, Garrett, in which the wear elements are accommodated in a V-section groove, the wear elements being held in place by cap screws. Only the cap screws provide surfaces for resisting the thrust forces and a broken or loosened cap screw will cause the wear element ordinarily held thereby to be dislodged.

A third type of fixed-contact stabilizer is shown in U.S. Pat. No. 4,106,823, Bassinger, in which tapered pairs of wear pads are wedged side by side in an accommodating slot, the pads being dovetailed along their sides and held thereby by tapered slot side surfaces to secure against lateral dislodging. Such pads are set in place by striking the ends with a mallet or hammer, with variable results depending on how well the tapered surfaces fit together and on the human element. High thrust loading and fretting can loosen and dislodge such pads during use either because the pads are not tightly seated or because the uneven surfaces do not permit uniform tightening along their entire lengths.

The history of fixed blade stabilizers leading up to the present invention may be approximated as follows:

Back in the 1950's stabilizer blades were welded on to the stabilizer body. When replacement was necessary, the blades were cut off with a torch and new ones were welded on. This construction is suitable for a wide range of sizes, e.g., 6 inches to 26 inches in diameter.

Later, it was decided that on the smaller sizes, e.g., $6\frac{1}{8}''$ to $7\frac{7}{8}''$, it was less expensive to form the stabilizer with integral blades and throw away the whole stabilizer when it was worn out. For lager sizes, e.g., diameters $7\frac{7}{8}''$ to $17\frac{1}{2}''$, it became the practice to form the blades so as to be integral with a sleeve which was shrunk fitted to the body. (For smaller sizes, exterior flow passage area would be too small to employ the shrink-sleeve construction.)

For those stabilizers where the shrink-sleeve construction was employed, the shrink-sleeve could be replaced when the blades were worn out. The old sleeve would be cut off with a torch, but heating of a new sleeve to be substituted required shop equipment. For field replacability, a construction in which the sleeve was screwed onto the body was developed, as shown in U.S. Pat. No. 3,754,609, Garrett.

For a similar range of sizes, e.g., $7\frac{7}{8}''$ to $17\frac{7}{8}''$, a less expensive stabilizer employing a body with integral blades and bolted on replaceable wear pads (studded with carbide inserts or hard faced) on the ends of the blades were introduced. (See, for example, U.S. Pat. No. 3,680,064, Crews, et al.; cf., U.S. Pat. No. 3,818,999, Garrett). Difficulty was experienced with occassional loss of the retention screws. See, for example, U.S. Pat. No. 4,280,742, Justman. In the larger sizes, excessive wear on the stabilizer nose (the tapered lower surfaces of the blades) was experienced. To protect against nose wear, blocks were welded into the lower tapered faces of the blades, (as is employed in the commerical product line of Drilco Division of Smith International, Inc.).

A proposal was made by the present inventor to provide a stabilizer having a body with integral blades and to drive fit into the blades round stepped wear pads (studded with carbide inserts or hard faced) with greater interference on the outer larger diameter cylindrical lands of the pads than on the inner smaller diameter cylindrical lands. These fits were similar to the fits for the stepped, round, shaft-supporting blocks employed at applicant's direction circa 1978–1979 by applicant's assignee in its roller stabilizers embodying the invention of applicant's U.S. Pat. 4,182,425, Garrett.

This proposal offered a structure that would be suitable for large diameter stabilizers, e.g., 14 inches or more in diameter, especially when employed with skewed blades, but would present problems due to insufficient exterior flow passages in the smaller sizes. This proposed stabilizer has not yet been built.

The present application construction provides a replaceable wear pad construction suitable for the full range of sizes from about $6\frac{1}{8}$ inches up to 26 inches and employs rectangular wear blade components (studded with carbide inserts or hard faced) with interference fits along the paraxial or lateral edges. A special interference fit is employed, as set forth hereinafter and delineated further below.

Therefore, it is a feature of the present invention to provide an improved stabilizer in which the wear elements are tightly secured in their respective accommodating pockets at least partially by an interference fit so as to minimize wear caused by movement of the elements within such pockets.

It is another feature of the present invention to provide an improved stabilizer in which the wear elements are installed by a lip-and-groove connection, which permits end-to-end close fitting of such elements in a common pocket, and which still permits ready removal for replacement purposes.

It is still another feature of the present invention to provide an improved stabilizer in which the wear elements are held, in part, by a block having connecting interlocking parts that secure the elements from becoming dislodged because of heavy longitudinal thrust loading.

SUMMARY OF THE INVENTION

The fixed-contact stabilizer embodiments of the invention herein disclosed employ, at each wear element, a technique for releasably securing such element in the tool body in such a manner as to ensure its being tighly held, even against the forces of fretting and heavy thrust loading. Each pocket in which one or more wear elements is accommodated and each of such elements is dimensioned to form an interference fit in the lateral or sideways direction therebetween. In one embodiment, the pocket also includes at its lower end an undercut recess for receiving a projection on the lower end of a wear element or blade. The upper end of the blade includes a similar recess so that additional elements can be positioned and locked within the pocket end-to-end. Also, the upper end of the wear blades includes a surface for accepting a dislodging or removal tool.

Also disclosed is a holding block for inserting in the pocket at the upper end of the blades in the pocket. The block does not outwardly extend sufficiently so as to contact the borehole and is not wide enough to form an interference fit with the pocket. The block does include a projection, similar to the projection on the blades, but the area outwardly of the projection is removed. In addition, the projection is rounded with a large radius. These two features permit insertion of the block into position by rotation about a pivot point close to the blade. The block is seated against the seating surface of the pocket without having to move longitudinally during installation. The block fits snugly with a transverse surface at the top of the pocket to form a thrust bearing surface for heavy longitudinal loads. The pocket is recessed at its surface and is slotted at the end for ease of securement and for accepting a removal tool.

Alternative to the use of a block, the blades can be installed in a pocket having a slightly angled top transverse surface for mating with a similarly angled wear blade top surface. Such pockets are also slotted so as to permit blade removal by an appropriate tool.

The wear blades include wear-resistant inserts or otherwise include a hard facing. The front or lower end of each blade is tapered and similarly treated for wear resistance.

An embodiment of the invention having the wear blades at an angle with respect to the tool body also includes a thrust bearing dowel insert intermediate the ends of each of such blades.

Uniform interference fit of a blade can be ensured by dimensioning the blade to have a width dimension slightly greater at its periphery than at a location deep within the accommodating pocket for a pocket having equal width dimensions at both locations. Alternatively, the underneath side of the blade can be slotted to provide some squeeze-like flexing of the legs made by the slotting of the blade, such flexing occurring deep within the pocket.

BRIEF DESCRIPTION OF THE DRAWINGS

So that the manner in which the above-recited features, advantages and objects of the invention, as well as others which will become apparent, are attained and can be understood in detail, more particular description of the invention briefly summarized above may be had by reference to the embodiments thereof which are illustrated in the appended drawings, which drawings form a part of this specification. It is to be noted, however, that the appended drawings illustrate only preferred embodiments of the invention and are therefore not to be considered limiting of its scope, for the invention may admit to other equally effective embodiments.

In the drawings:

FIGS. 3A-3C is a partial cross-sectional view of alternate arrangements to that shown in FIG. 3 showing relief grooving.

FIG. 4 is a partial cross-sectional view of a preferred stabilizer blade in accordance with the present invention.

FIG. 5 is a partial cross-sectional view of another preferred stabilizer blade in accordance with the present invention.

FIG. 6 is a partial longitudinal cross-sectional view of a preferred interlocking blade arrangement in accordance with the present invention.

FIG. 7 is a partial cross-sectional view of an alternate preferred interlocking blade arrangement in accordance with the present invention.

FIG. 8 is a plan view of the alternate interlocking blade arrangement shown in FIG. 7.

DESCRIPTION OF THE PREFERRED EMBODIMENTS

Figure 1:
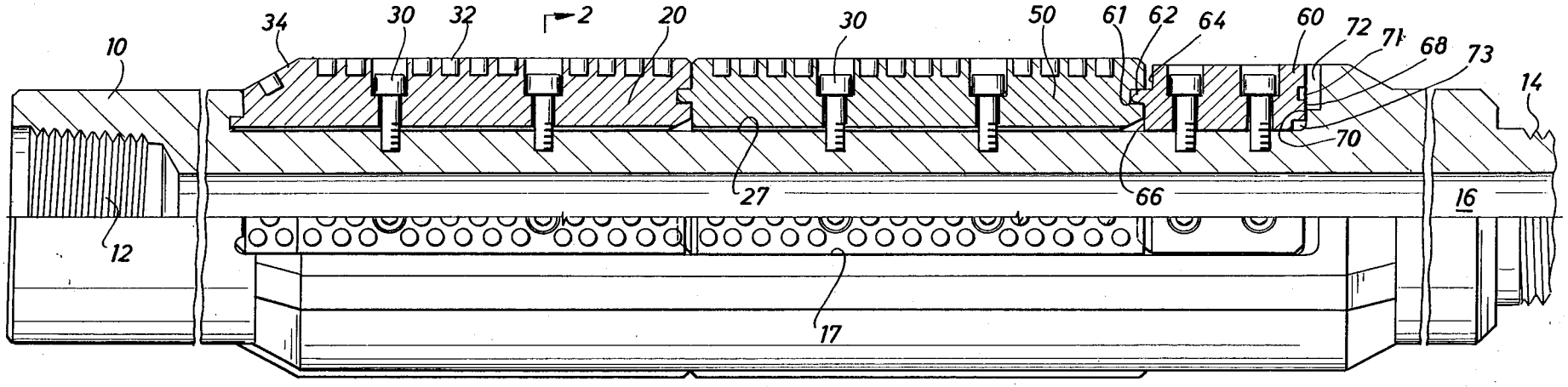
FIG. 1 is a longitudinal cross-sectional view of a portion of a fixed blade stabilizer in accordance with the present invention.

Now referring to the drawings, and first to FIG. 1, a stabilizer in accordance with the present invention is shown in longitudinal cross-section. Body 10 of the illustrated stabilizer tool is threaded at threads 12 and 14 for suitable connection to adjoining members cooperatively threaded therewith in the drill string. As is shown, threads 12 appear in the box or lower end of the tool and threads 14 appear in the pin or upper end of the tool, as illustrated. This section of the drill string can alternatively be included in the string in the opposite direction, if desired. The body of the stabilizer includes a fluid circulation hole 16 therethrough and is normally screwed into the drill bit, or, at least, is located not too far above the drill bit. As is noted above, the usual position of a stabilizer is in connection with the collar section, which is 100–300 feet above the bit. Located about the body are a plurality of pockets 17 for accommodating wear-resistant inserts, also referred to as "wear elements" or "wear blades", in accordance with the present invention. For illustration purposes, four such pockets are shown evenly spaced around the circumference of the tool; however, three or more such pockets may be employed, if desired.

Although the wear blades do project or extend beyond the peripheral surface of the tool body, it is helpful to include at least shallow angle longitudinal recesses 18 (FIG. 2) between the pockets so as to provide ample outside fluid circulation passage.

As is best shown in FIG. 6, lower blade 20 of a typical series of blade elements located in a stabilizer pocket includes at its lower end an interlock means in the form of a projection 22 or hold-down lip, sometimes referred to as a "tang", at a deep position within the pocket. Projection 22 is suitably accommodated by a mating interlock means in the form of a deep undercut recess 24 in the lower end of pocket 17, preferrably contiguous with seating surface 27 of pocket 17. It should be noted that recess 24 includes a small radius 26 at its deepest location and that adjacent radius 28 of mating projection 22 is a somewhat larger radius for a purpose to be described hereinafter.

Blade 20 is bored at one or more places for accommodating hold-down cap screws 30 and body 10 is bored and tapped from seating surface 27 in alignment therewith for accommodating the cap screws, as shown. It should be noted that the cap screws are countersunk below the exposed or wear surface of the wear element. Further, the wear surfaces of the blades include preferably hard-surface or wear resistant inserts 32 pressed therein by interference fit, such inserts being made of tungsten carbide steel of the like.

The lower part of each wear blade extends or is exposed beyond the limits of the enlarged section of the body and is tapered at lower taper 34, which also includes one or more inserts 32.

The upper end of the wear blade includes an undercut recess 61 similar to recess 24; however, recess 36 has a location other than adjacent the seating surface or bottom of the pocket. Recess 61 also includes a small radius 38 at its deepest location, again similar to recess 24. A slant surface 40 to receive a drive out tool, as hereinafter described, is undercut in the top of the wear blade adjacent to the seating pocket surface.

Figure 3:
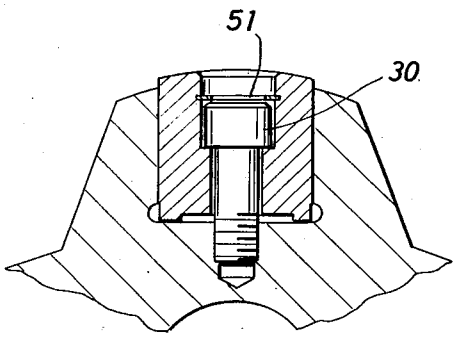
FIG. 3 is a partial cross-sectional view of an alternate cap screw arrangment useful in the invention shown in the various embodiments disclosed herein.

Upper blade 50 is similar in construction to lower blade 20 except that lower projection 52 is positioned to be in alignment with receiving recess 61 of the lower blade, rather than a receiving recess adjacent the deep or bottom seating surface of the accommodating pocket, such as with projection 22. Also similar to the lower blade, the blade is bored for the receipt of hold-down cap screws 30 and the body opposite each such bore is bored and tapped for the receipt of such a cap screw. Like the lower blade, the upper blade bores are countersunk and the surface is prepared with hardfacing inserts. A retainer ring 51 may be employed above each of the cap screws as a safety feature against losing an inadvertent loosened cap screw, as shown in FIG. 3.

Except for slight chamfers, there is no tapering of the wear surface upper blade at either end, however, as with taper 34 on the lower blade. The extended wear surface, however, is protected by wear inserts or the like, as in the case with the lower blade.

Returning to FIG. 1, it will be seen that located adjacent upper blade 50 in block 60, which is provided with a projection 62 for accommodation within recess 61, which is in the upper end of the upper blade and is substantially identical to recess 61 described above for the lower blade. Because of this substantial identity of recesses, the same number is assigned for descriptive purposes. Block projection 62 has a larger radius on it underneath side than the adjacent radius of recess 36, for purposes to be hereinafter described. The contacting or meeting transverse surfaces of upper blade 50 and block 60 are close-fitting or abutting; however, above or outwardly from projection 62, block 60 is spaced apart from top surface 64 of blade 50. Therefore, the only abutment contact between blade 50 and block 60 is at block surface 66 below projection 62. It should be noted that upper blade 50 does include an undercut slant surface adjacent the bottom of the pocket to receive a drive out tool, such as with the lower blade.

Block 60 includes a top surface 68 which is close-fitting or abutting with a transverse surface 70 on the top part of the pocket. This transverse surface is at a large, preferably right angle with respect to the longitudinal axis of the tool. However, it should be noted that surface 70 does not extend outwardly to the surface of the body, but there is a space in front of surface 72, as shown. It may also be noted that the top edge surface of block 60 is notched slightly at notch 71 at the top surface of the block to permit the use of a pry out tool (not shown). There is also an undercut at notch 73 next to the seating surface of the pocket to facilitate seating of block 60.

Block 60 is held in position, in addition to projection 62, by one or more cap screws. Block 60 is bored for such cap screws 30 and the body of the tool is bored and tapped opposite such block bores to accommodate these cap screws. The cap screws may be countersunk in the block, although it should be noted that the block does not extend above the surface limits of the body and certainly not above the wear surface of blade 50.

Figure 2:
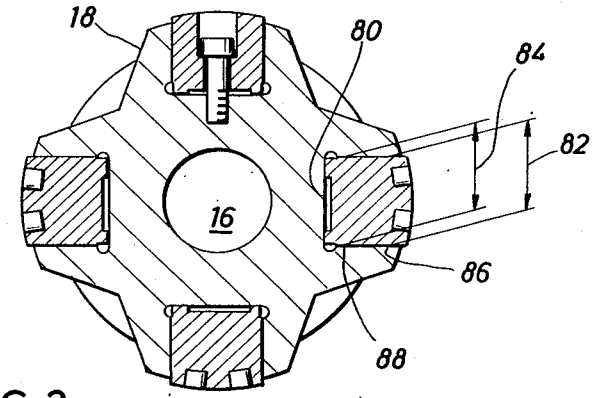
FIG. 2 is a cross-sectional view taken at line 2—2 of FIG. 1.

There are alternate wear blades shown from their end views in FIG. 2, FIGS. 3–3C, FIGS. 4 and 5, each alternative suitable for inclusion in the embodiment shown in FIG. 1. Each of the wear blades of FIG. 2 is shown to have approximately parallel sides wherein the sides of the wear blade are dimensioned so as to form an interference fit with the approximately parallel sides of the accommodating pocket. Furthermore, it may be noted that there is a void 80 deep within the pocket to provide for liquid and debris passage and to assure metal-to-metal seating of the blade within the pocket of the body.

One way of insuring a tight interference fit, so that the blade does not become loose even in the presence of extremely hard operating conditions, is to dimension the blade and the accommodating pocket in a manner hereafter described. Assuming that the pocket sides are parallel as shown in the end view, the width dimension at blade periphery 82 is made to be slightly greater than the width dimension of the periphery of the blade at 84, deeper within the pocket. Alternately, if the sides of the blade are parallel, it is possible to dimension the width dimension at the periphery of the pocket near the body surface at 86 to be slightly smaller than the dimension between the sides of the pocket deeper within the pocket, at contacts 88.

It should be noted that such a structure is contrary to that achieved in ordinary machining, which inherently for a slot such as the pocket shown, makes the external portion of the pocket slightly larger than the internal portions, even though the intent of the machining is to make the sides absolutely parallel.

The principal objective of the lateral interference fit is to insure that each blade component to be held tightly at the mouth of the respective pocket or slot and snugly at the bottom of the slot. When a tangential force is applied to a blade component, the blade tends to bend about one edge of the mouth and pull loose from the other edge. If there is any separation, drilling fluid (which is abrasive) will work its way into the crack, and there will also be fretting which will gradually loosen the blade. On the other hand, if the blade component remains gripped by the mouth of the slot, it will make little difference how tight the bottom of the slot grips the blade so long as it is a snug fit to prevent rocking of the blade in the slot. There is very little force tending to pull the blade component radially out of the slot and the screws satisfy that holding requirement.

In view of the foregoing and the fact that reduced-interference-fit gripping of each blade component will make it easier to insert during manufacture and remove for assembly, it may be preferred to interrupt the interference fit along one or both sides (between the mouth and the bottom of each blade).

Figure 3A:
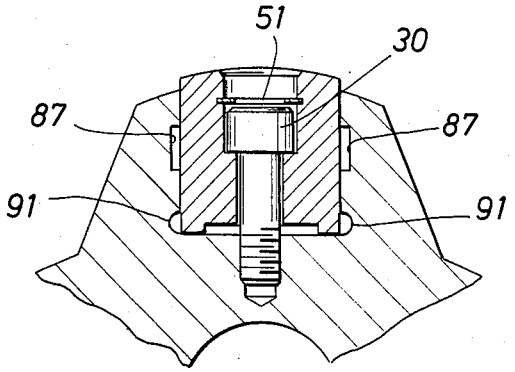
Figure 3B:
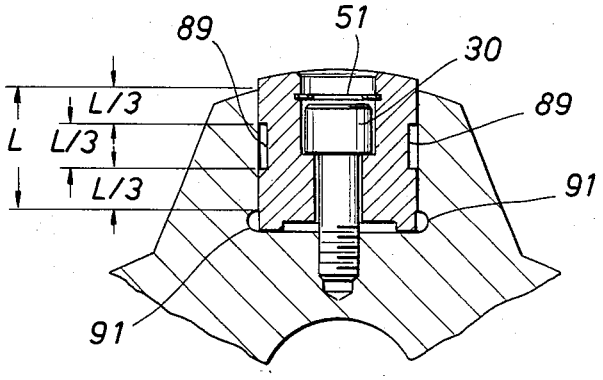
Figure 3B:
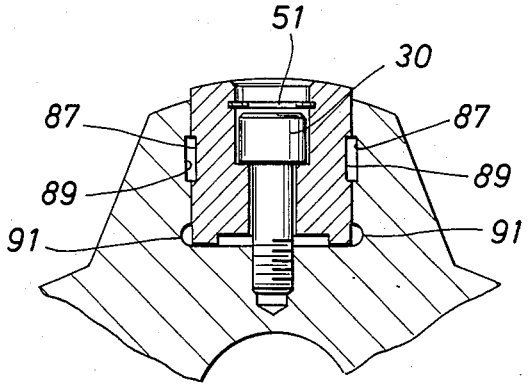

Referring now to FIGS. 3A, 3B, and 3C, which are views similar to FIG. 3 showing modifications, such interruption can be effected either by providing relief grooving in one or both sides of each slot, as shown at 87 in FIG. 3A, or at one or both sides of each blade component, as shown at 89 in FIG. 3B, or in both the slot and blade component, as shown in FIG. 3C. As there shown, the relief grooves occupy about one-third of the radial extent L of the side of each blade component or slot that would be engaged absent the groove and are positioned about midway of such radial extent. In this regard it may be noted that the sides of the blades do not engage the slots immediately adjacent the bottom due to the fillets 91. Other widths and positioning of the grooving may be employed.

Although relief grooves 87 and 89 are of rectangular cross-section and extend the full lengths of the sides of each slot and blade component, other cross-sections and lengths of grooving can be used.

An alternate wear blade structure which insures a tighter gripping of the blade near its external periphery than at an internal periphery location is shown in FIG. 5. In such a structure, the blade is slotted at slot 90 from end-to-end to provide legs 92 and 94, which are more resilient or flexible than at the external periphery when the metal is slightly deformed in establishing the interference fit connection. It should be noted that slot 90 is fairly large and preferably, in the end view shown, is cut more than half the distance of the length of the interference fit..

In this FIG. 5 embodiment, the machining of the pocket sides and the wear blade sides is such to provide an interference fit in normal fashion. However, when the blade is forced into the pocket, legs 92 and 94 flex slightly inwardly, being somewhat more resilient than the outer periphery dimension of the wear blade, with the result being that the blade is held more tightly in the pocket at its outer periphery than its internal periphery.

If a slot, such as above described for receiving blade components, is cut in a flat bar of dimension considerably larger than the slot, e.g., by first roughing out the slot and then finish cutting the sides with a cantilever shaft milling cutter, the resulting slot may have nearly parallel sides. However, bending moment on the rotating tool used for finishing the slot will cause the mouth of the slot to be slightly wider than the bottom of the slot.

If a blade component having parallel sides is driven into a slightly narrower slot having parallel sides, the compressive stress in the inner part of the blade component, near the bottom of the slot, will be greater than that at the mouth of the slot. That is because at the bottom of the slot expansion is resisted not only by compressive forces in the metal at the sides of the slot but also by tensile forces in the metal at the bottom of the slot.

If a cylindrical steel body is provided with a plurality of azimuthally spaced paraxial parallel sided slots and a slightly wider parallel sided blade component is driven into each slot, the compressive stress at the mouth of each slot will be less than that at the mouth of each slot in a comparable situation in a flat body of steel. That is because there is more metal at the outer periphery of the cylindrical body to absorb the strain than there is nearer the axis of the body. The same result is true if the slots are in arms that are thicker near the bottoms of the slots than at the mouths, e.g., due to the provision of flow channels as shown at 18 in FIG. 2.

Summarizing, for a variety of reasons there is a tendency for an intended uniform interference fit of the blade components and body slot to produce greater compressive stress at the bottom of the slot. If the stress at the bottom of the slot is greater than at the mouth of the slot, the once parallel sides of the slot no longer are such, instead they flare outwardly resulting in forces tending to push the blade components out of the slot. The slight taper will be less than the friction angle, so the taper will be a seizing taper. Nevertheless, as noted previously in connection with the embodiments of FIGS. 3A, 3B, 3C, only a certain amount of interference stress can be tolerated if the blade components are to be driven in and driven out, and the most important place for a stressed fit is at the mouth of each pocket or slot, rather than at the bottom. So for maximum retentivity compatible with assembly and replacement, the stress should be greatest at the mouth of the slot and minimal at the bottom of the slot. If all the stress is at the bottom and the mouth is free, the blade components will tend to wiggle out of the pockets or slots. According to the invention this tendency is overcome by providing fits that insure that the stress on the blade components is uniform or else is greater at the mouths of the slots than at the bottoms of the slots.

If the foregoing result is achieved, no particular amount of interference or compressive stress is required beyond that needed to resist external forces tending to pull the bladed components out of their slots. The actual interferences required to achieve the desired result will not vary much with the size of the tool, for the bigger tools there will be bigger areas of engagement between blade components and slots, resulting in greater retention forces for the same amount of interference. As illustrative of a suggested amount of interference that may be suitable, the mouth interference may be 2 to 5 thousandths of an inch and the bottom interference may be 1 to 4 thousandths of an inch. That is, the greater width of the blade may be 2 to 5 thousandths of an inch greater than the width of this slot or pocket at the mouth thereof, and 1 to 4 thousandths of an inch greater than the width of the slot or pocket at the bottom thereof. In other words, there may be 1 or 2 thousandths more interference at the mouth than at the bottom of each slot with 2 to 5 thousandths interference at the mouth and even down to zero interference at the bottom. Note that if the interference is too great at the bottom, it may not be possible to drive the blade components into the slots, or else the sides of the slots and blade components may be galled, or the outer faces of the blade components may be damaged, even if a soft steel or lead mallet is used to drive the blades into the slots.

The foregoing interference values are for solid blade components. If the blades are V slotted as shown in FIG. 5, or otherwise relieved along the inner edges, so as to make the sides flexible, then a uniform interference from mouth to bottom of, e.g., 2 to 5 thousandths would be suitable.

Now turning to FIGS. 9–12, a series of views is shown for positioning lower blade 20, upper blade 50 and block 60 within a pocket 17. It should be noted that the parts are illustrated in simplified form and that parts not relevant to the procedure are not illustrated in these views.

Figures 9, 10, 11, 12:
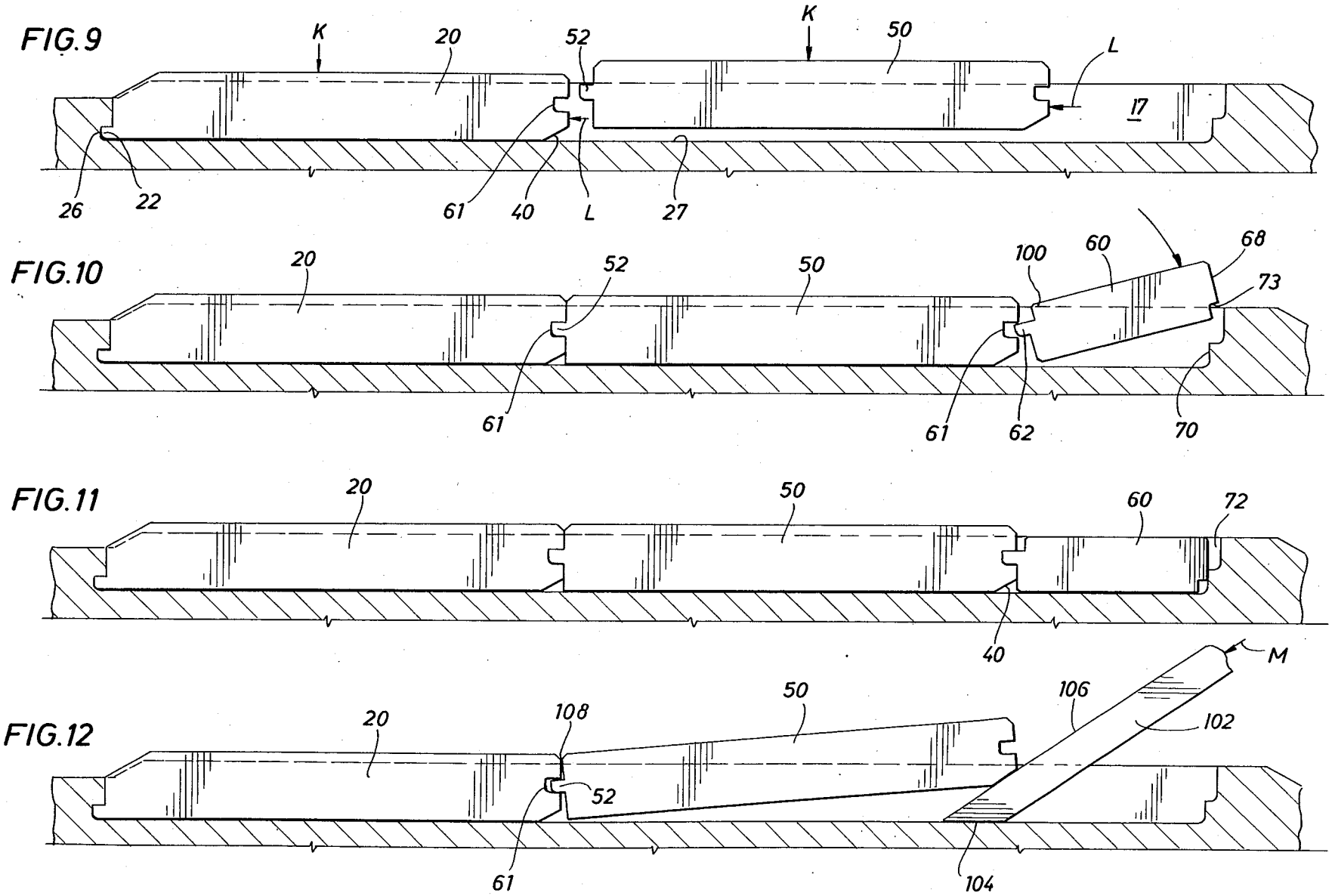
FIGS. 9-12 are a schematic representation of installing and removing blades in a preferred stabilizer arrangement in accordance with the present invention.
Figure 13:
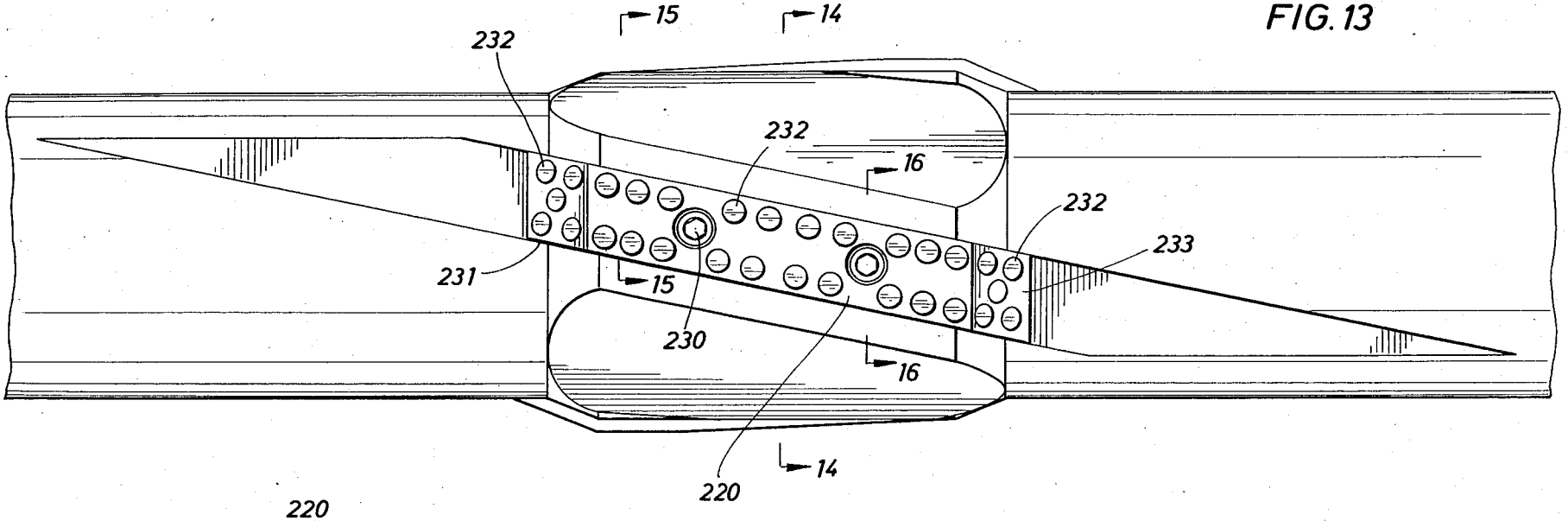
FIG. 13 is a partial plan view of an alternate blade stabilizer in accordance with the present invention.
Figure 15:
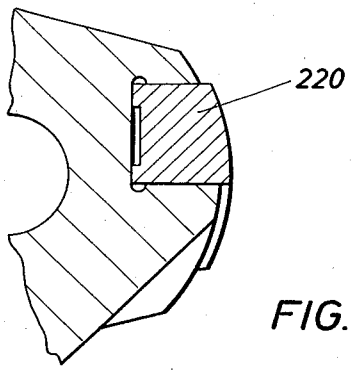
FIG. 15 is a partial cross-sectional view taken at line 15—15 of FIG. 13.
Figure 14:
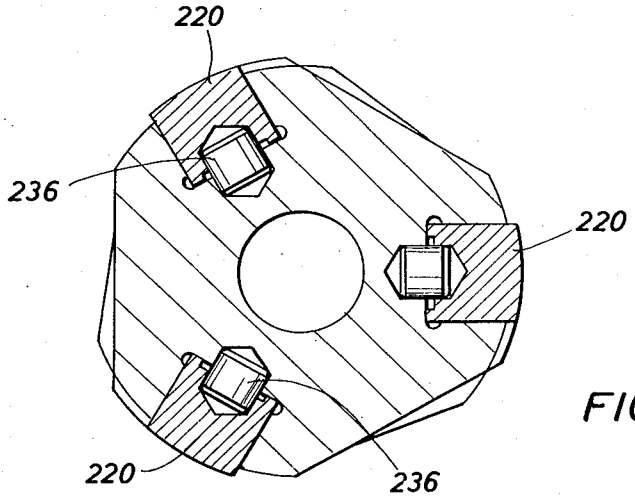
FIG. 14 is a cross-sectional view taken at line 14—14 of FIG. 13.

In FIG. 9, lower wear blade 20 is tightly forced laterally in direction K toward the bottom or seating surface 27 of the pocket, as shown. Blade 20 is then forced downwardly or longitudinally in direction L so that projection 22 is forced into undercut recess 26. Upper wear blade 50 is then forced into the pocket in direction K until it is seated against seating surface 27 of the accommodating pocket. Blade 50 is then forced downwardly in longitudinal direction L so that projection 52 is forced into undercut recess 61 on the top surface of lower blade 20.

Intermediate wear blades (not shown) similar in appearance to wear blade 50 can be similarly joined end-to-end between the lower blade and the upper blade depending on the number of wear blades employed within the pocket.

Locking block 60 is then inserted as shown in FIGS. 10 and 11. The corner above projection 62 which is closest to block 50 is designated corner 100 and forms a pivot point for the rotation of block 60, as shown by the arrow. This permits projection 62 to fit into recess 61 in the top face of the wear blade. As the blade is rotated, it locks so that its top face or surface 68 is pressed in close fit with transverse surface 70 formed in the top of the pocket. Please note that space 72 is located outwardly of surface 70 and that in its final position space 64 is located outwardly of projection 62. Furthermore, notch 73 ensures that there is no undesirable interference between the pocket and the block as it is rotated into position.

Now referring to FIG. 12, disassembly of the wear blades for replacement purposes is illustrated. It may be seen that block 60 has already been removed, access for such removal being provided by space 72. It may be remembered that block 60 is not held by an interference fit by the sides of the pocket, so all that is needed is the rotation of block 60 upward sufficiently to clear surface 70. Tapered surfaces 40 adjacent the seating surfaces of the accommodating pocket provide a surface for the insertion of a removal tool driven in a direction M. Removal tool 102 has a tapered surface 104 parallel to seating surface 27 and a top surface 106 parallel to surface 40. In the removal process, upper blade 50 is rotated about a pivot surface 108 at the upper contact point between blades 20 and 50. Such pivoting disengages projection 52 from recess 61 so that upper blade 50 can be removed completely. Removal tool 102 then is used to pry and dislodge and thereby provide removal of lower blade 20 in a manner similar to the removal of upper blade 50 just described.

The removal tool, alternatively, can be a puller tool as well as a forward-advancing, prying type tool.

An alternate connection means for an alternate wear blade construction is illustrated in FIGS. 7 and 8. In this structure, lower blade 20' has a top surface that provides a shoulder 36' at a countersunk or recess position for accommodating cap screw 30', which is substantially identical with cap screws 30. In like fashion, the bottom face surface of upper blade 50' is provided with a shoulder 52' at a countersunk or recess position for accommodating cap screw 30'. An overhang lip 53' is provided in the rear face of blade 50' so that the head of cap screw 30' fits into the space between lip 53' and shoulder 52'. The body of the tool is bored and tapped for receipt of cap screw 30' in the position shown at the mid position between blades 20' and 50'.

In installing the wear blades of this configuration, lower blade 20' is snugly placed into position in the same manner as described for blade 10, the lower face and the accommodating recess being identical for the two configurations. Screw 30' is then screwed down to shoulder 36', but not tightened. Then shoulder 52' is tucked under the head of cap screw 30' and the blade is rotated to the position of use against the seating surface of the pocket. Cap screw 30' is then tightened against shoulders 36' and 52'.

Additional or intermediate wear blades of similar construction can be installed in the same manner end-to-end in between the lower and upper blades. Finally, a locking block is installed, as with the previously described embodiment.

Figure 18:
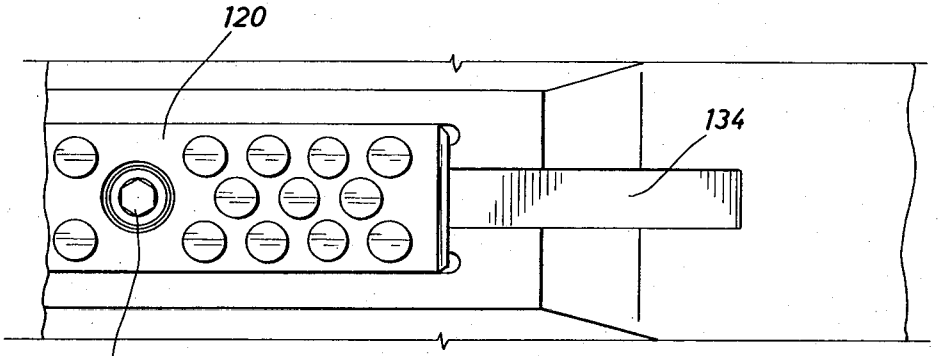
FIG. 18 is a partial plan view taken at line 18—18 of FIG. 17.
Figure 16:
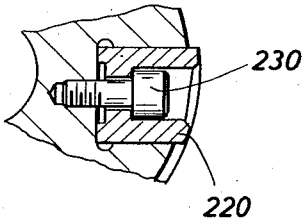
FIG. 16 is a partial cross-sectional view taken at line 16—16 of FIG. 13.
Figure 17:
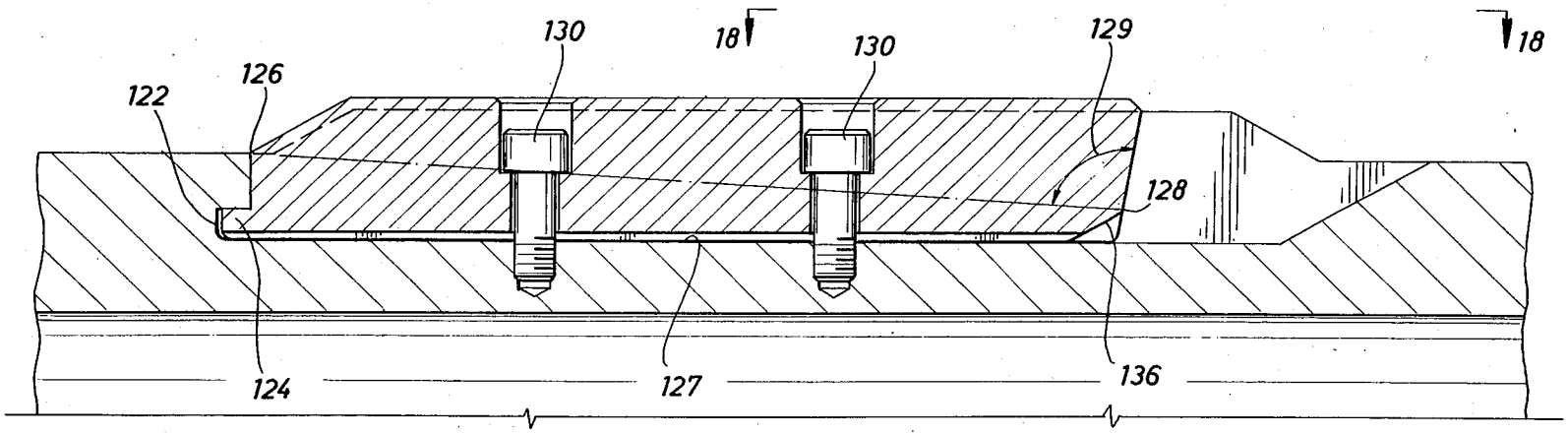
FIG. 17 is a partial longitudinal cross-sectional view of an alternate preferre.d stabilizer in accordance with the present invention.

Now referring to FIGS. 17 and 18, an embodiment of the invention showing a single wear blade 120 is shown accommodated by a pocket without employing a locking block. The accommodating pocket includes at its lower end an undercut recess 122 similar to recess 24 shown in FIG. 6. The recess includes a small radius adacent seating surface 127 of the pocket. The lower end of wear blade 120 includes projection 124 which is suitable for insertion within recess 122. Similar to the embodiments previously described, projection 124 includes a large radius. The top face or surface of wear blade 120 is angled slightly in a manner to permit its seating as illustrated, against a transverse limit surface of the pocket, which is similarly angled or slanted. In inserting the wear blade shown, the lower part of the blade is placed against the surface corner of pocket 126 and the blade is rotated so that projection 124 rotates into recess 122 as the seating surface of the blade and pocket come together. In order to permit this, a line drawn from point 126 to the deepest contacting point along the top surface, which is point 128, must form an angle 129 of 90 degrees or more with respect to the transverse surface of the pocket.

Blade 120 is bored for the receipt of cap screws 130 and the body is bored and tapped in alignment therewith for the receipt of cap screws in a manner similar to other embodiments. Likewise, the surface of the wear blade is treated or has wear inserts embedded therein to provide a hard, wear-resistant surface for the blade. Also, the lower end is tapered and treated in a manner previously discussed with other embodiments.

The top part of the accommodating pocket is contiguous with a slot 134, which is slotted to the depth of seating surface 127 of the pocket. Blade 120 includes a slanted, undercut surface 136 on the leading and deepest face portion of the top surface of the wear blade. A removal tool similar to that previously described may be employed for dislodging the wear blade by being placed in slot 134 and wedging (or pulling) up on surface 136.

Although only one blade is shown in FIG. 17, a number of blades can be accommodated end-to-end, such as with the embodiment shown in FIG. 1. In such instance, the blades will be interlocked as with the FIG. 1 embodiments and include cap screws for holding down each blade. The top blade of such multi-blade embodiment has the upper surface configuration with the pocket, as shown in FIGS. 17 and 18.

Now referring to FIGS. 13–16, an alternate embodiment of the invention is shown which deploys wear blades 220 at an angle to the longitudinal axis of the tool. In this embodiment, wear blades 220, each having encased in their outer surfaces wear resistant inserts 232, are accommodated in appropriate pockets by cap screws 230 in a manner similar to the other embodiments. A wear blade 220 is resiliently held within its accommodating pocket by elastic deformation in an interference fit in a manner similar to that previously described. Both the leading or lower edge 231 of the wear blade and the upper or trailing edge of the wear blade is tapered and includes wear resistant inserts in a manner similar to the treatment for its elongate wear surface. In this embodiment, the accommodating pocket does not include a transverse thrust bearing surface. Instead, thrust pin 236 is employed intermediate the ends of the blade in an accommodating hole on the underneath side of wear blade 220 and in an aligned hole within the body of the tool.

It may be seen that the embodiment of this angular wear blade tool illustrates three wear blades positioned at regular intervals around the periphery of the tool. However, a different number of blades can be employed, as desired. It should also be noted that in this tool, the face of the periphery between the wear blades is not rounded or angled out, but flattened, to provide adequate outside fluid circulation passage.

Employment of tightly secured components in each of the embodiments, which are also releasable, results in the elimination of fretting which has heretofore caused rapid wearing of stabilizer wear elements in the prior art.

Also, the embodiments shown herein each employ at least lateral interference fit within the pockets and cap screws and some of the embodiments additionally provide recess-and-projection longitudinal and locking block connections. All of the embodiments provide auxiliary means in addition to cap screws for carrying heavy thrust loading. Such back up and failsafe provisions assure maximum security against accidental dislodging of the wear blades, loss of wear blades because of stress corrosion of the cap screws or improperly tightened cap screws or the like.

Some note also needs to be taken of the difference, as regards interference fits, between round blocks and rectangular blade components interfering only laterally. In the case of a round block, interfering about its entire periphery, the curvature of the cylindrical body in which the block socket is formed will provide less stress in the circumferential direction at the mouth of the socket than at the bottom, but paraxially the difference in stress between mouth and bottom will be less. Therefore, if an effort is made to equalize the bottom and mouth stresses by increasing the interference at the mouth of the socket, equalization in the circumferential direction will result in excessive stress at the body. This problem does not exist in the case of rectangular slots and blade components interfering only laterally.

Another distinction that may be noted between round blocks interfering around their entire peripheries and rectangular blade components interfering only laterally lies in the fact that the blocks may expand to the direction of their free ends, thereby reducing the stress. It may be desirable, therefore, to use greater interferences for rectangular blade components interfering latterally than for round blocks interfering about their entire circumference. The greater interference and resulting greater stain causes the rectangular blade components to remain tight in their slots despite external forces which might loosen round blocks with lesser interference.

Another distinction between peripherally interference-fitted round blocks and laterally interference-fitted rectangular blade components lies in the size limitations imposed on the former. If a round block has the same extent in the direction of the axis of the stabilizer body as does a rectangular blade component, the round block will necessarily have the same extent circumferentially of the stabilizer body, whereas the rectangular component can be of elongated shape and have a much smaller circumferential or lateral extent. Unless the diameter of the stabilizer body is large, the lateral portions of cylindrical sockets to receive round blocks will extend too close to the external fluid passages (spaces between blades) of the stabilizer, leaving insufficient wall thickness to provide the desired interference fit. As an extreme example, consider the construction of FIGS. 13–14, which is substantially to scale and represents a $9\frac{7}{8}$ inch diameter stabilizer. If a round block were employed having the same diameter as the length of the rectangular blade there shown, the block diameter would be larger than the diameter of the stabilizer body. A characteristic of the invention is the employment of elongated blades or blade components having a length of at least five times the blade width, adapting the construction to the full range of stabilizer sizes.

Another distinction between round block construction and rectangular blade component construction lies in the fact that in the latter a single slot may be employed for each blade, whereas in the round block construction, a number of separate sockets will ordinarily be required for each blade. Even in the case of large diameter stabilizers where the blade components may have a less than five-to-one length/width ratio, the slot employed will have at least a five-to-one length/width ratio.

Stepped interference construction, e.g., with round blades, also needs to be distinguished from straight sided, lateral interfering construction such as is employed in the present invention. Each successive step forms another mouth and another bottom for the socket, with a looser fit at each mouth than at the bottom unless applicant's stress equalizing construction is employed. A stepped construction with greater interference at the outer land than at the inner land may therefore still have greater stress at the bottom of each land than at the outer portion thereof resulting in a force component tending to push the block out of its socket. By tapering the side of the blade or slotting the underside thereof, applicant achieves a more nearly uniform stress distribution or a greater stress at the mouth of the slot than at the bottom, thereby more securely holding the blade or blade component in the slot.

Although numerous embodiments have been shown and described, it will be understood that the invention is not limited thereto since many modifications may be made and will become apparent to those skilled in the art.

What is claimed is:

1. Borehole contacting apparatus adaptable for use as an element in a drill string, comprising an annular elongated body having a fluid circulation hole therethrough and threaded at each end for connection within a drill string to adjoining members cooperatively threaded therewith, a plurality of outwardly opening elongated slotted pockets about said body having substantially parallel elongated body sides, and a plurality of releasably securable wear blades, at least one of said blades being accommodated in each of said pockets, each of said blades extending radially beyond the surface of said body, each of said blades having substantially parallel sides for respective interference mating engagement with said parallel elongated body sides of said pockets, each of said blades being held tightly within its accommodating pocket by elastic deformation of at least one of said blade and body.

2. Borehole apparatus in accordance with claim 1, wherein an uppermost blade accommodated in each of said pockets includes an engagement surface actionable by a removal tool.

3. Borehole apparatus in accordance with claim 2, wherein said engagement surface is an undercut recess.

4. Borehole apparatus in accordance with claim 1, wherein each of said pockets includes a transverse limit surface and including end abutment thrust means between the end of at least one blade in each of said pockets and pocket limit surface.

5. Borehole apparatus in accordance with claim 4, wherein said pocket limit surface is at an outwardly slanting obtuse angle with respect to said at least one accommodated blade, said pocket including a notch for accommodating a removal tool for dislodging said blade.

6. Borehole apparatus in accordance with claim 1, and including thrust means intermediate the ends of each of said blades.

7. Borehole apparatus in accordance with claim 1, wherin respectively each of said blades is bored radially with respect to said body for the receipt of at least one cap screw, said body being bored and tapped in alignment therewith, and including a cap screw for additionally releasably securing said respective blades at each cap screw bore.

8. Borehole apparatus in accordance with claim 7, wherein each of said pockets includes a limit surface at a large angle with respect to said parallel body sides, and including end abutment thrust means between the end of at least one blade in each of said pockets and said pocket limit surface.

9. Borehole apparatus in accordance with claim 8, wherein an uppermost blade accommodated in each of said pockets includes an engagement surface actionable by a removal tool.

10. Borehole apparatus in accordance with claim 9, wherein said removal tool includes wedging surfaces for providing blade dislodging.

11. Borehole apparatus in accordance with claim 1, wherein each of said pockets includes first interlock means in the end of said pocket nearest the lower end of the apparatus as it is located within the drill string, and where the adjacent accommodated blade includes a second interlock means connectable with said first interlock means.

12. Borehole apparatus in accordance with claim 1, wherein each of said pockets includes an undercut recess in the end of said pocket nearest the lower end of the apparatus as it is located within the drill string, and wherein the adjacent accommodated blade includes a projection for mating with said undercut recess in the respective accommodating pocket.

13. Borehole apparatus in accordance with claim 12, wherein the lower extended surface of said lowermost accommodated blade in each of said pockets is tapered, and including a wear resistant surface on said tapered surface.

14. Borehole apparatus in accordance with claim 12, wherein the inside portion of said undercut recess includes a curvilinear surface with a small radius, and wherein said mating projection includes a contiguous curvilinear surface with a radius larger than said small radius of the curvilinear surface of said undercut recess.

15. Borehole apparatus in accordance with claim 12, and including a second respectively accommodated blade in each of said accommodating pockets, the upper end of said first-named blade including a second recess, said second blade including a second projection for mating with said second recess.

16. Borehole apparatus in accordance with claim 12, and including a second respectively accommodated blade in each of said accommodating pockets, the upper end of said first-named blade including a first shoulder at a recess for its extended surface, said body having a hole bored and tapped in alignment with said upper end, the lower end of said second blade including a second shoulder at a recess from its extended surface, and including a cap screw accommodated in said hole for securing within the accommodating pocket the upper end of said first-named blade and the lower end of said second blade.

17. Borehole apparatus in accordance with claim 12, and including a block respectively accommodated in each of said accommodating pockets between the uppermost blade and the upper end of the pocket, the upper end of said uppermost blade including a second recess, said block including a second projection for mating with said second recess.

18. Borehole apparatus in accordance with claim 17, wherein the inside portion of said second recess includes a curvilinear surface with a small radius, and wherein said mating projection from said block includes a contiguous surface with a radius larger than said small radius of the curvilinear surface of said second recess, said block being cut away outwardly of said mating projection to permit rotational insertion of said block with no substantial longitudinal movement thereof.

19. Borehole apparatus in accordance with claim 17, wherein the upper end of each of said pockets includes a limit surface at a large angle with respect to said parallel body sides deep within said pocket, said pocket being cut away outwardly thereof to permit rotational insertion of said block with no substantial longitudinal movement thereof, so that the blades within said pockets are restricted from substantial longitudinal thrust movement.

20. Borehole apparatus in accordance with claim 17, wherein said block extends less than radially beyond the surface of said body, the sides of said block being spaced apart less than said parallel elongated body sides so as not to form an interference mating engagement therewith.

21. Borehole contacting apparatus adaptable for use as an element in a drill string, comprising an annular elongated body having a fluid circulation hole therethrough and threaded at each end for connection within a drill string to adjoining members cooperatively threaded therewith, a plurality of outwardly opening elongated slotted pockets about said body having substantially parallel elongated body sides, and a plurality of releasably securable wear blades, at least one of said blades being accommodated in each of said pockets, each of said blades extending radially beyond the surface of said body, and means for assuring a tighter gripping of each of said wear blades near its outer periphery than deeper within its accommodating pocket.

22. Borehole apparatus in accordance with claim 21, wherein an uppermost blade accommodated in each of said pockets includes an engagement surface actionable by a removal tool.

23. Borehole apparatus in accordance with claim 22, wherein said removal tool includes wedging surfaces for providing blade dislodging.

24. Borehole apparatus in accordance with claim 22, wherein said engagement surface is an undercut recess.

25. Borehole apparatus in accordance with claim 21, wherein the sides of said blades and the corresponding sides of said accommodating pockets are dimensioned to form an interference fit therebetween, the dimensions at the outer periphery of said blades and said pockets interfering more than the dimensions thereof deep within said pockets.

26. Borehole apparatus in accordance with claim 21, wherein the sides of said blades and the corresponding sides of said accommodating pockets are dimensioned to form an interference fit therebetween, the inner portion of each of said blades including an elongated slot so that the outer periphery of each of said blades is less resilient than it is deep within its accommodating pocket.

27. Borehole apparatus in accordance with claim 21, wherein each of said pockets includes a limit surface at a large angle with respect to the thrust loading direction on said accommodated blades, and including end abutment thrust means between the end of at least one blade in each of said pockets and said pocket limit surface.

28. Borehole apparatus in accordance with claim 27, wherein said pocket limit surface is at an outwardly slanting obtuse angle with respect to said at least one accommodated blade, said pocket including a notch for accommodating a removal tool for dislodging said blade.

29. Borehole apparatus in accordance with claim 28, wherein said removal tool includes wedging surfaces for providing blade dislodging.

30. Borehole apparatus in accordance with claim 21, and including thrust means intermediate the ends of each of said blades.

31. Borehole apparatus in accordance with claim 21, wherein respectively each of said blades is bored radially with respect to said body for the receipt of at least one cap screw, said body being bored and tapped in alignment therewith and including a cap screw for additionally releasably securing at each cap screw bore said respective blades.

32. Borehole apparatus in accordance with claim 31, wherein each of said pockets a limit surface at a large angle with respect to the thrust loading direction on said accommodated blades, and including end abutment thrust means between the end of at least one blade in each of said pockets and said pocket limit surface.

33. Borehole apparatus in accordance with claim 32, wherein an uppermost blade accommodated in each of said pockets includes an engagement surface actionable by a removal tool.

34. Borehole apparatus in accordance with claim 21, wherein each of said pockets include first interlock means in the end of said pocket nearest the lower end of the apparatus as it is located within the drill string, and wherein the adjacent accommodated blade includes a second interlock means connectable with said first interlock means.

35. Borehole apparatus in accordance with claim 21, wherein each of said pockets includes an undercut recess in the end of said pocket nearest the lower end of the apparatus as it is located within the drill string and wherein the adjacent accommodated blade includes a projection for mating with said undercut recess in the respective accommodating pocket.

36. Borehole apparatus in accordance with claim 35, wherein the lower extended surface of said lowermost accommodated blade in each of said pockets is tapered, and including a wear resistent surface on said tapered surface.

37. Borehole apparatus in accordance with claim 35, wherein the inside portion of said undercut recess includes a curvilinear surface with a small radius, and wherein said mating projection includes a contiguous curvilinear surface with a radius larger than said small radius of the curvilinear surface of said undercut recess.

38. Borehole apparatus in accordance with claim 35, and including a second respectively accommodated blade in each of said accommodating pockets, the upper end of said first-named blade including a second recess, said second blade including a second projection for mating with said second recess.

39. Borehole apparatus in accordance with claim 35, and including a second respectively accommodated blade in each of said accommodating pockets, the upper end of said first-named blade including a first shoulder at a recess from its extended surface, said body having a hole bored and tapped in alignment with said upper end, the lower end of said second blade including a second shoulder at a recess from its extended surface, and including a cap screw accommodated in said hole for securing within the accommodated pocket the upper end of said first-named blade and the lower end of said second blade.

40. Borehole apparatus in accordance with claim 35, and including a block respectively accommodated in each of said accommodating pockets between the uppermost blade and the upper end of the pocket, the upper end of said uppermost blade including a second recess, said block including a second projection for mating with said second recess.

41. Borehole apparatus in accordance with claim 40, wherein the inside portion of said second recess includes a curvilinear surface with a small radius, and wherein said mating projection from said block includes a contiguous surface with a radius larger than said small radius of the curvilinear surface of said second recess, said block being cut away outwardly of said mating projection to permit rotational insertion of said block with no substantial longitudinal movement thereof.

42. Borehole apparatus in accordance with claim 41, wherein the upper end of each of said pockets includes a limit surface at a large angle with respect to said parallel body sides deep within said pocket, said pocket being cut away outwardly thereof to permit rotational insertion of said block with no substantial longitudinal movement thereof, so that the blades within said pockets are restricted from substantial longitudinal thrust movement.

43. Borehole apparatus in accordance with claim 40, wherein said block extends less than radially beyond the surface of said body, the sides of said block being spaced apart less than said parallel elongated body sides so as not to form an interference mating engagment therewith.

44. Borehole apparatus comprising a tubular body having a flow axis, said body having a plurality of equiazimuthally spaced substantially parallel sided slots each extending in a direction having at least a paraxial component, and blade means received in each slot making an interference fit with the sides of the slot.

45. Apparatus according to claim 44, the lateral stress on the sides of the blade means being at least as great at the mouth of each slot as at the bottom thereof.

46. Apparatus according to claim 44, each slot having a length-width ratio of at least five-to-one.

47. Apparauts according to claim 44, each blade means having outwardly flaring side walls.

48. Apparatus according to claim 44, each blade means being recessed along the length of the inner edge thereof.

49. Apparatus according to claim 44, each slot having two sides and a bottom, the junctures of the sides and bottom being filleted.

50. Apparatus according to claim 44, including supplemental radial retention means for retaining each blade means in its slot against radial withdrawal therefrom, and paraxial retention means independent of said radial retention means for transferring paraxial loads on the blade means to the body.

51. Apparatus according to claim 50, wherein said paraxial retention means comprises dowel pin means in the bottom of each slot extending into sockets at the inner edge of each blade means.

52. Apparatus according to claim 44, wherein each slot has locking means at the ends thereof, and each blade means has locking means at the ends thereof for locking with the locking means at the ends of the slot.

53. Apparatus according to claim 52, wherein each blade means comprises a plurality of components each having locking means at its ends for locking with the adjacent ones of the locking means on the adjacent components and at the ends of the slot.

54. Apparatus according to claim 44, wherein each of said slots has a mouth at the peripheral surface of said tubular body and a bottom at a penetration distance therefrom, each slot being recessed at the sides intermediate the mouth and bottom thereof.

55. Apparatus accoridng to claim 44, wherein each of said slots has a mouth at the peripheral surface of said tubular body and a bottom at a penetration distance therefrom, each blade means being recessed at its sides intermediate the mouth and bottom of the slot.

56. Apparatus according to claim 44, wherein each of said slots has a mouth at the peripheral surface of said tubular body and a bottom at a penetration distance therefrom, there being relief between at least one side of each slot and the adjacent side of each blade means intermediate the mouth and bottom of the slot.

* * * * *